US011851914B2

(12) United States Patent
Balci et al.

(10) Patent No.: US 11,851,914 B2
(45) Date of Patent: Dec. 26, 2023

(54) FITTING ARRANGEMENT FOR A SLIDING WINDOW OR A SLIDING DOOR

(71) Applicant: Roto Frank Fenster—und Tuertechnologie GmbH, Leinfelden-Echterdingen (DE)

(72) Inventors: Erkan Balci, Filderstadt (DE); Winfried Reich, Berglen (DE)

(73) Assignee: Roto Frank Fenster—un Tuertechnologie GmbH, Leinfelden-Echterdingen (DE)

( * ) Notice: Subject to any disclaimer, the term of this patent is extended or adjusted under 35 U.S.C. 154(b) by 597 days.

(21) Appl. No.: 17/053,112

(22) PCT Filed: Apr. 16, 2019

(86) PCT No.: PCT/EP2019/059733
§ 371 (c)(1),
(2) Date: Nov. 5, 2020

(87) PCT Pub. No.: WO2019/214908
PCT Pub. Date: Nov. 14, 2019

(65) Prior Publication Data

US 2021/0238890 A1 Aug. 5, 2021

(30) Foreign Application Priority Data

May 9, 2018 (DE) ..... 10 2018 111 201.7

(51) Int. Cl.
*E05B 65/00* (2006.01)
*E05B 65/08* (2006.01)
(Continued)

(52) U.S. Cl.
CPC ..... *E05B 65/0864* (2013.01); *E05D 15/1013* (2013.01); *E05C 9/025* (2013.01);
(Continued)

(58) Field of Classification Search
CPC ..... E05B 65/0864; E05B 65/087; E05B 65/0876; E05B 65/0823; E05D 15/1013;
(Continued)

(56) References Cited

U.S. PATENT DOCUMENTS 6,585,301 B1 7/2003 Prevot et al.
8,915,020 B2 * 12/2014 Sauter ..... E06B 7/2318 187/400
(Continued)

FOREIGN PATENT DOCUMENTS

CN 1239176 A 12/1999
CN 106193806 A 12/2016
(Continued)

OTHER PUBLICATIONS

English translation of the International Preliminary Report on Patentability and Written Opinion of the International Searching Authority in PCT/EP2019/059733, dated Nov. 10, 2020.
(Continued)

*Primary Examiner* — Chi Q Nguyen
(74) *Attorney, Agent, or Firm* — Collard & Roe, P.C.

(57) ABSTRACT

A fitting arrangement for a sliding window or a sliding door has an actuating mechanism that can be arranged on a sliding sash and that is movable at least with a portion in the rebate circumferential direction, and a first control element that is arranged on the portion of the actuating mechanism, and a second control element that is arranged on a transverse slide. The transverse slide has a locking element, and the control elements interact and are tailored to one another in such a way that, upon a movement of the portion in the locking direction, the locking element is moved away from the sliding sash perpendicularly to a main plane of the sliding window or of the sliding door.

9 Claims, 3 Drawing Sheets

(51) Int. Cl.
*E05D 15/10* (2006.01)
*E05C 9/02* (2006.01)

(52) U.S. Cl.
CPC ..... *E05Y 2201/22* (2013.01); *E05Y 2900/132* (2013.01); *E05Y 2900/148* (2013.01)

(58) Field of Classification Search
CPC . E05D 2015/1026; E05C 9/025; E05C 9/042; E05Y 2201/22; E05Y 2201/23; E05Y 2900/132; E05Y 2900/148
See application file for complete search history.

(56) References Cited

U.S. PATENT DOCUMENTS

| | | | | |
|---|---|---|---|---|
| 10,077,594 | B2 * | 9/2018 | Fingerle | E05D 15/10 |
| 10,180,015 | B1 * | 1/2019 | Grainger | E05D 15/22 |
| 11,002,065 | B2 * | 5/2021 | Balbach | E06B 7/2316 |
| 11,085,216 | B2 * | 8/2021 | Reich | E05D 15/10 |
| 11,118,385 | B2 * | 9/2021 | Hawkinson | E05F 5/003 |
| 11,428,033 | B2 * | 8/2022 | Beutel | E05D 15/0691 |
| 2004/0163317 | A1 * | 8/2004 | Reich | E05D 15/565 49/226 |
| 2005/0028946 | A1 * | 2/2005 | Weishar | E05F 15/643 160/214 |
| 2010/0154174 | A1 * | 6/2010 | Haab | E05F 15/605 49/358 |
| 2014/0246157 | A1 * | 9/2014 | Letonje | E06B 9/0646 160/188 |
| 2016/0145932 | A1 * | 5/2016 | Fingerle | E06B 1/04 49/413 |
| 2019/0292828 | A1 * | 9/2019 | Liu | E05B 3/00 |

FOREIGN PATENT DOCUMENTS

| | | | |
|---|---|---|---|
| EP | 1580362 | A1 | 9/2005 |
| EP | 2682545 | A1 | 1/2014 |
| EP | 2778329 | A1 | 9/2014 |
| EP | 2829679 | A1 | 1/2015 |

OTHER PUBLICATIONS

Chinese Office Action/Search Report dated Jun. 1, 2021 issued in the corresponding Chinese Application Serial No. 201980028306.9 (with English translation of relevant parts).
International Search Report dated Jul. 4, 2019 issued in PCT/EP2019/059733.
German Office Action dated Apr. 4, 2019 issue in the corresponding German Application No. 10 2018 111 201.7 (with English translation of relevant parts).

* cited by examiner

FITTING ARRANGEMENT FOR A SLIDING WINDOW OR A SLIDING DOOR

CROSS REFERENCE TO RELATED APPLICATIONS

This application is the National Stage of PCT/EP2019/059733 filed on Apr. 16, 2019, which claims priority under 35 U.S.C. § 119 of German Application No. 10 2018 111 201.7 filed on May 9, 2018, the disclosures of which are incorporated by reference. The international application under PCT article 21(2) was not published in English.

BACKGROUND OF THE INVENTION

The invention relates to a fitting arrangement for a sliding window or a sliding door having an actuating mechanism that can be arranged on a sliding sash and that is movable at least with a portion in the rebate circumferential direction, and a first control element that is arranged on the portion of the actuating mechanism, and a second control element that is arranged on a transverse slide, wherein the transverse slide has a latch element.

The invention also relates to a sliding window or a sliding door having a fitting arrangement according to the invention.

To be able to close the sash of a sliding door or a sliding window tightly, a sash should be able to be pressed against a seal perpendicularly to its main plane, in particular a circumferential seal, provided on a fixed field, a fixed frame or another sash. For this purpose, a locking arrangement can be used that must be able to ensure that the sash is suitably tightened on a seal so that when the sash is locked, it is pressed firmly against the circumferential seal. From EP 2 778 329 A1, for example, a locking arrangement is known that has a bearing element that can be fastened to a sash, a fixed frame or a fixed field of the sliding door or the sliding window, and a transverse slide arranged on the bearing element so as to be movable relative thereto, wherein the transverse slide has a control element that, in the assembled state of the locking arrangement, interacts with an actuating device of the sliding door or the sliding window and has a striker. The striker cooperates with a closing piece that is arranged, for example, on a fixed sash or a fixed frame. When the sash is closed, the striker of the locking arrangement moves into the closing piece and can then be displaced perpendicularly to the main plane of the sliding door or sliding window to thereby press a sash against a seal.

Such sliding doors are locked with another spar on the handle-side vertical spar to prevent the sash from shifting in the slide opening direction. A certain amount of play must be built in here to compensate for assembly tolerances. If, for example, a sash locked in this way is subjected to a certain force in the horizontal slide opening direction during a break-in attempt, a striker arranged on the vertical spar facing away from the handle may slide out of the closing piece. This means that there is no longer sufficient protection against break-ins.

SUMMARY OF THE INVENTION

The object of the present invention is therefore to further develop a fitting arrangement in such a way that a movement of the sliding sash of a sliding door or a sliding window may be prevented when the sliding sash is locked per se.

This object is achieved according to the invention by a fitting arrangement for a sliding window or a sliding door having an actuating mechanism that can be arranged on a sliding sash and that is movable at least with a portion in the rebate circumferential direction, and a first control element that is arranged on the portion of the actuating mechanism, and a second control element that is arranged on a transverse slide, wherein the transverse slide has a latch element, and the control elements interact and are matched to one another in such a way that, upon a movement of the portion in the locking direction, the latch element is moved away from the sliding sash perpendicularly to a main plane of the sliding window or of the sliding door. This measure makes it possible for the latch element to engage in a corresponding receptacle in a fixed frame or a fixed spar such that the sliding sash cannot be moved relative to the fixed frame or the fixed spar. The fixed spar may be part of a fixed frame, a fixed field or another (sliding) sash that is locked in its position. The transverse slide of the fitting arrangement according to the invention is thus movable in the opposite direction of the transverse slide of the displacement arrangement described above. While the transverse slide and the striker arranged thereon are thus used to pull the sash onto a fixed frame, a fixed field or another (sliding) sash, i.e., the striker is moved in the direction of the sliding sash, the transverse slide of the fitting arrangement according to the invention causes an opposite movement to be carried out to fix the sliding sash in an immovable manner at least in its sliding direction.

A sash fastening part may be provided on which the transverse slide is displaceably arranged. The sash fastening part may be fixedly attached to the sliding sash, and the transverse slide may be guided through the sash fastening part and be arranged to be movable relative to the sash fastening part.

One of the control elements may be designed as a control contour that extends at least in portions transversely to the rebate circumferential direction and the other control element may be designed as a control pin that cooperates with the control contour. For example, a control pin may be provided on the portion of the actuating mechanism, which control pin engages in a corresponding control contour of the transverse slide. The control contour may, for example, be designed as a connecting link. In this way, the transverse slide may be controlled in a particularly simple manner.

The latch element may be fastened to the transverse slide, in particular it may be screwed into the transverse slide. This facilitates the assembly of the fitting arrangement. In particular, the transverse slide and the sash fastening part may first be installed and then the latch element may be connected to the transverse slide, in particular screwed into it. Furthermore, depending on the frame or sash profiles used, the possibility exists to use latch elements of different lengths to ensure in this way that the latch element can actually interact with a fixed spar arranged opposite thereto.

According to a further embodiment of the invention, a counterpart to the locking element may be provided, which counterpart has a receptacle for positively receiving the locking element. In particular, the receptacle may surround the locking element in a form-fitting manner. The counterpart may be arranged on a fixed frame or a fixed spar. Thus, the locking element and therefore the sliding sash may not only be fixed in place in one sliding direction, but the sliding sash may also be prevented from being lifted. Due to the fitting arrangement, in particular the interaction of the locking element and counterpart, the sliding sash can thus be fixed both in the vertical and in the horizontal direction. The counterpart may be made of steel and screwed into the spar. This results in a particularly stable arrangement.

It is particularly preferred if the receptacle is designed as a through-hole. Thus, the locking element may fully engage through the counterpart.

Further advantages result if the portion of the actuating mechanism is a driving rod portion. One of the control elements may thus be arranged on the driving rod portion.

A third control element may be provided on the actuating mechanism, which third control element interacts with a fourth control element of a second transverse slide that has a striker, wherein the third and fourth control elements are tailored to one another in such a way that, upon a movement of the actuating mechanism, in particular the portion, in the locking direction, the striker is moved toward the sliding sash perpendicularly to the main plane of the sliding window or of the sliding door. Thus, two transverse slides may be provided on the fitting arrangement, which transverse slides, upon a movement of the actuating mechanism, in particular the driving rod, move in opposite directions in the locking direction. Thus, on the one hand, a sash may be pulled onto a fixed frame or a fixed field or another (sliding) sash and, on the other hand, a locking element may be extended to fix the sliding sash in its position.

A sliding window or a sliding door with a fitting arrangement according to the invention also falls within the scope of the invention.

According to one embodiment, it may be provided that an in particular stationary spar, in particular of a fixed frame, a fixed field or another (sliding) sash, has a recess in the region of the receptacle of the counterpart for at least partial reception of the locking element. Thus, the locking element may not only be fixed in its position by the counterpart, but also by a spar, in particular a fixed field or a fixed frame or the like. This can also ensure that the locking element may fully engage through the counterpart.

Further features and advantages of the invention are apparent from the following detailed description of an embodiment of the invention with reference to the accompanying drawings, which show details essential to the invention, and from the claims. The features shown there are not necessarily to be taken to scale and are shown in such a way that the special features according to the invention can be made clearly visible. The various features can each be implemented individually for themselves or for a plurality of combinations of any kind in variants of the invention.

The schematic drawing shows embodiments of the invention and the subsequent description explains them in more detail.

BRIEF DESCRIPTION OF THE DRAWING FIGURES

Figure 4A:
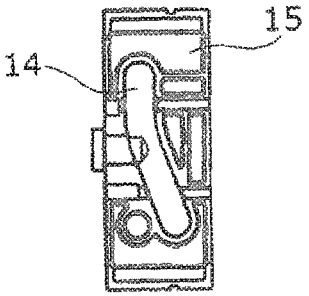
Figure 4B:
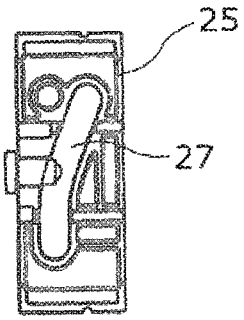
Figure 5:
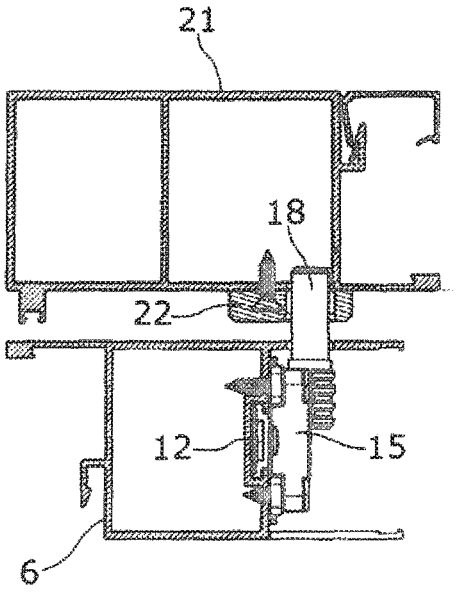

FIG. 4*a* is a view of the rear of a first transverse slide;

FIG. 4*b* is the view of the rear of a second transverse slide;

FIG. 5 is a cross-sectional view of a locking position; and

Figure 6:
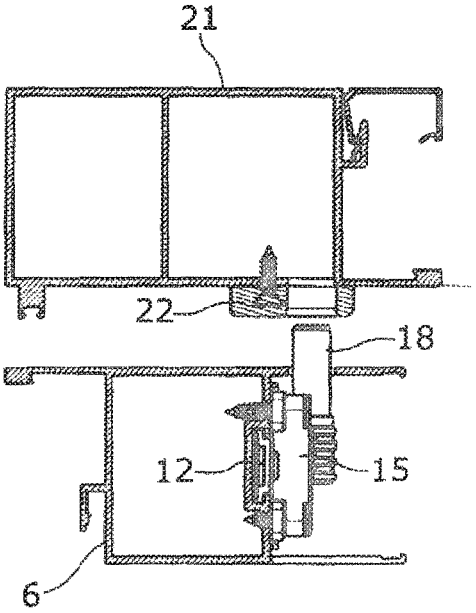

FIG. 6 shows the unlocked position.

DETAILED DESCRIPTION OF THE INVENTION

Figure 1:
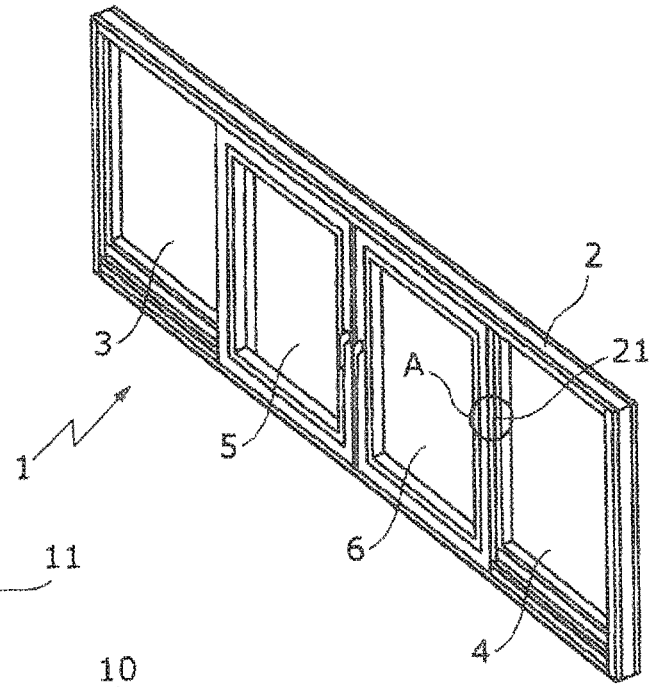
FIG. 1 is a perspective view of a sliding door.

FIG. 1 shows a sliding door 1 having a fixed frame 2, two fixed fields 3, 4 and two sliding sashes 5, 6. To open the sliding door 1, the sashes 5, 6 may be pushed across the fixed fields 3, 4. To seal the sashes 5, 6 in the position shown, they must be pulled perpendicularly to their main plane in the direction of the fixed frame 2 or vertical spars 21 of the fixed fields 3, 4. This is done, for example, with the help of a locking arrangement at point A.

Furthermore, the sliding sashes 5, 6 must be prevented from being displaceable in a locked position in the slide opening direction (a previously customary play must be at least be reduced). This can be achieved by a fitting arrangement according to the invention, which is described below with reference to FIG. 2.

The fitting arrangement 10 according to the invention comprises an actuating mechanism 11 that comprises a portion 12 that in this case is designed as a driving rod portion. The portion 12 comprises a first control element 13 (see FIG. 3) that interacts with a second control element 14 (see FIG. 4*a*). The control element 14 is arranged on the rear side of a first transverse slide 15 that is held by a sash fastening part 16 on a spar 17 of the sliding sash 6 and is displaceable relative thereto perpendicularly to the main plane of the sliding door 1.

The first transverse slide 15 has a locking element 18 that, together with the transverse slide 15, is displaceable perpendicularly to the main plane of the sliding sash 6 or of the sliding door 1. Accordingly, when the portion 12 is moved in the locking direction, the locking element 18 is moved away from the sliding sash 6 in the direction of the spar 21. In this case, the locking element 18 ends up in a counterpart 22, more precisely in a receptacle 23 of the counterpart 22, that is fastened to the spar 21. The receptacle 23 is designed as a through-hole and surrounds the locking element 18 circumferentially. The locking element 18 is accordingly arranged in a locked position in the receptacle 23 in a form-fitting manner.

Figure 2:
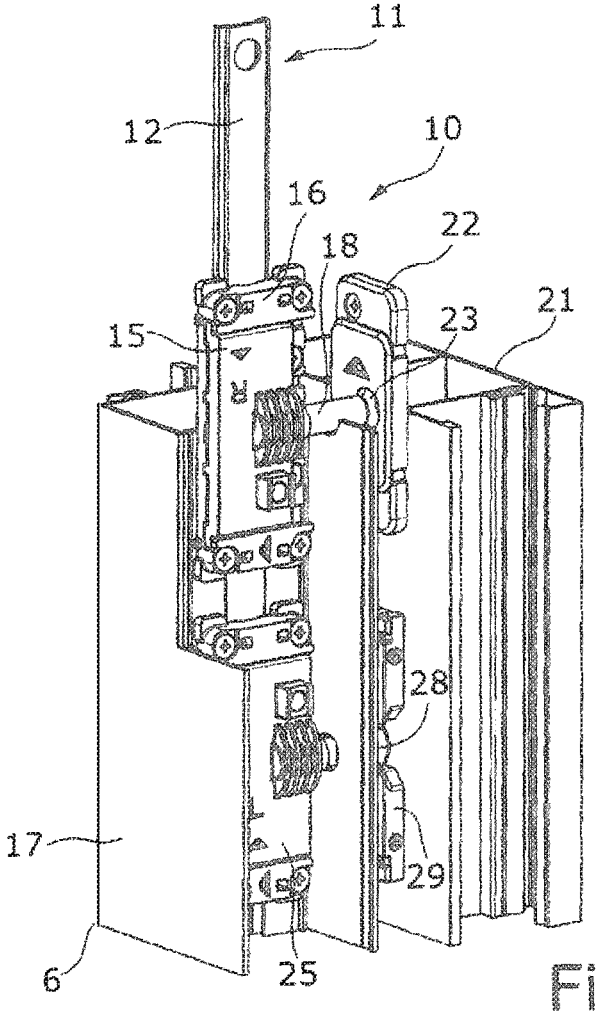
FIG. 2 is a section in region A of FIG. 1.

FIG. 2 shows an unlocked position in which the locking element 18 is shown at a distance from the counterpart 22.

Furthermore, a second transverse slide 25 can be seen in FIG. 2, which second transverse slide, like the transverse slide 15, is coupled to the actuating mechanism 11 in terms of movement. For this purpose, the portion 12 has a third control element 26 (see FIG. 3) that interacts with a fourth control element 27 (see FIG. 4*b*). When the portion 12 moves in the locking direction (downward), however, the transverse slide 25 is moved in the opposite direction to the transverse slide 15, i.e., a locking element 28 arranged on transverse slide 25, which striker interacts with a striker 29 that is also attached to the spar 21, is moved toward the sliding sash 6 such that the sliding sash 6 is pulled against the spar 21.

Figure 3:
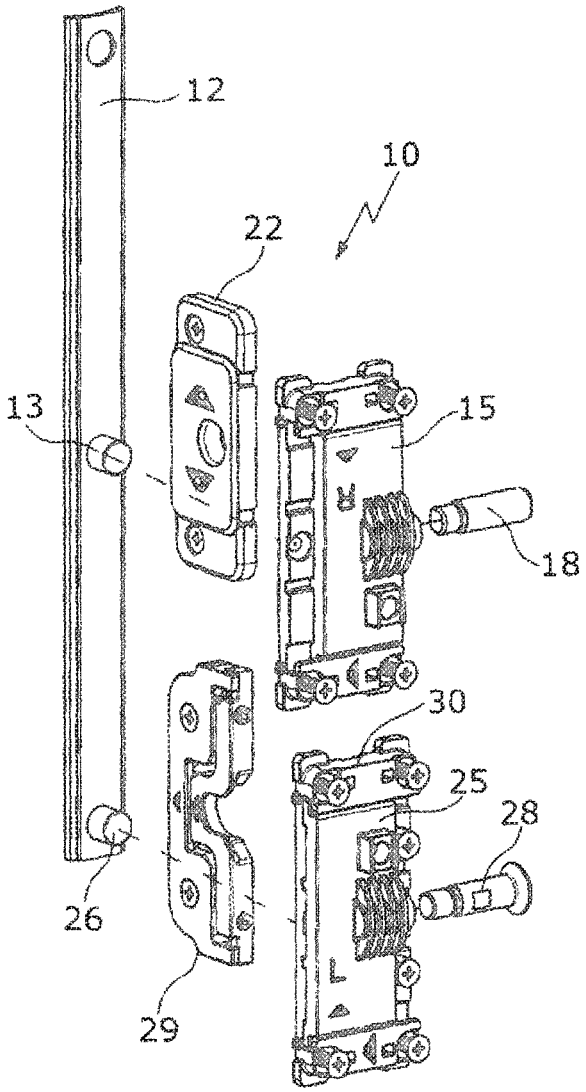
FIG. 3 is an exploded view of the fitting arrangement according to the invention.

FIG. 3 is an exploded view of the fitting arrangement 10 according to the invention. The same reference numerals are used for the parts described with reference to FIG. 2. As can be seen from FIG. 3, both the latch element 18 and the striker 28 may be screwed into the respective transverse slides 15, 25. This facilitates assembly on the sliding door 1. The transverse slide 25 is also held on the sliding sash 6 by a sash fastening part 30 and is guided through the sash fastening part 30.

FIG. 4*a*, 4*b* are a top view of the rear side of the transverse slides 15, 25. In particular, the control elements 14, 27 can be seen there, which are designed as control contours and are bent in opposite directions. This means that when the portion 12 moves in the locking direction, one transverse slide is moved away from the sliding sash 6 and the other transverse slide is moved toward the sliding sash 6. When the portion 12 moves in the unlocking direction, the opposite movement of the transverse slides 15, 25 takes place.

FIG. 5 is a cross-sectional view for a locking position. Here it can be seen that the latch element 18 engages in the counterpart 22 or penetrates the receptacle 23 and partially protrudes into the spar 21.

FIG. 6 shows the unlocked position. Here it can be seen that the latch element 18 is no longer in engagement with the counterpart 22 such that a sliding movement of the sliding sash 6 is possible.

What is claimed is:

1. A fitting arrangement for a sliding window or sliding door having an actuating mechanism that is configured to be arranged on a sliding sash and that is movable at least with a portion in a rebate circumferential direction, a first control element that is arranged on the portion of the actuating mechanism, and a second control element that is arranged on a transverse slide, wherein the transverse slide has a locking element, and the first and second control elements interact and are matched to one another so that, upon a movement of the portion in a locking direction, the locking element is moved away from the sliding sash perpendicularly to a main plane of the sliding window or of the sliding door wherein a third control element is provided in the actuating mechanism, wherein the third control element interacts with a fourth control element of a second transverse slide that has a striker, wherein the third and fourth control elements are matched to one another so that, upon the movement of the actuating mechanism in the locking direction, the striker is moved toward the sliding sash perpendicularly to the main plane of the sliding window or of the sliding door.

2. The fitting arrangement according to claim 1, wherein a sash fastening part is provided on which the transverse slide is displaceably arranged.

3. The fitting arrangement according to claim 1, wherein one of the control elements is designed as a control contour that extends at least in portions transversely to the rebate circumferential direction and wherein an other control element of the control elements is designed as a control pin that cooperates with the control contour.

4. The fitting arrangement according to claim 1, wherein the locking element is configured to be fastened to the transverse slide.

5. The fitting arrangement according to claim 1, wherein a counterpart to the locking element is provided, which counterpart has a receptacle for positively receiving the locking element.

6. The fitting arrangement according to claim 5, wherein the receptacle is designed as a through-hole.

7. A sliding window or sliding door having a fitting arrangement according to claim 5, wherein a stationary spar of the fixed frame or a fixed field has a recess in a region of the receptacle of the counterpart for at least partial reception of the locking element.

8. The fitting arrangement according to claim 1, wherein the portion is a driving rod portion.

9. A sliding window or sliding door having a fitting arrangement according to claim 1.

* * * * *